US010807380B2

(12) United States Patent
Arakane et al.

(10) Patent No.: US 10,807,380 B2
(45) Date of Patent: Oct. 20, 2020

(54) IMAGE PROCESSING DEVICE, PRINTING APPARATUS, AND STORAGE MEDIUM

(71) Applicant: Brother Kogyo Kabushiki Kaisha, Nagoya-shi, Aichi-ken (JP)

(72) Inventors: Satoru Arakane, Nagoya (JP); Masashi Kuno, Obu (JP); Shota Morikawa, Nagoya (JP); Shin Hasegawa, Nagoya (JP); Yoshiharu Furuhata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/570,417

(22) Filed: Sep. 13, 2019

(65) Prior Publication Data

US 2020/0086654 A1 Mar. 19, 2020

(30) Foreign Application Priority Data

Sep. 15, 2018 (JP) ..... 2018-173136

(51) Int. Cl.
*B41J 2/21* (2006.01)
*B41J 25/00* (2006.01)
*B41J 2/045* (2006.01)

(52) U.S. Cl.
CPC ..... *B41J 2/2121* (2013.01); *B41J 25/006* (2013.01); *B41J 2/04593* (2013.01)

(58) Field of Classification Search
CPC .... B41J 2/2121; B41J 2/2132; B41J 2/04508; B41J 2/04593; B41J 2/04595; B41J 25/006
See application file for complete search history.

(56) References Cited

U.S. PATENT DOCUMENTS 7,762,640 B2 * 7/2010 Kanda ..... B41J 2/0452 347/12
9,050,821 B2 * 6/2015 Konno ..... B41J 2/2125

FOREIGN PATENT DOCUMENTS

JP 2004-066550 A 3/2004

* cited by examiner

*Primary Examiner* — Thinh H Nguyen
(74) *Attorney, Agent, or Firm* — Banner & Witcoff, Ltd.

(57) ABSTRACT

An image processing device causing a printing execution unit to: in a first case where a specific condition indicating that ink supply from an ink supply unit to a printing head may be delayed in partial printing is not satisfied, print a partial image by single partial printing; in a second case where the specific condition is satisfied, print the partial image by partial printings including a first partial printing and a second partial printing; in the first case, form a dot having a specific size by the single partial printing, as a dot corresponding to a specific pixel in the partial image; and in the second case, form a dot having a size smaller than the specific size by the first partial printing and form a dot having a size smaller than the specific size by the second partial printing, as the dot corresponding to the specific pixel.

17 Claims, 12 Drawing Sheets

FIG. 7A

DETERMINATION THRESHOLD VALUE TABLE TT

| | | HEAD TEMPERATURE | | |
|---|---|---|---|---|
| | | LOW | MEDIUM | HIGH |
| CUMULATIVE-USE AMOUNT OF INK | SMALL | 70% | 85% | 100% |
| | MEDIUM | 65% | 80% | 100% |
| | LARGE | 60% | 75% | 100% |

FIG. 7B

REPLACEMENT TABLE RT

| PARTIAL DOT DATA (BEFORE REPLACEMENT) | FIRST DOT DATA | SECOND DOT DATA |
|---|---|---|
| EXTRA-LARGE | MEDIUM | LARGE |
| LARGE | MEDIUM | MEDIUM |
| MEDIUM | NO DOT | MEDIUM |
| SMALL | NO DOT | SMALL |
| NO DOT | NO DOT | NO DOT |

FIG. 10A

SECOND EXEMPLARY EMBODIMENT

REPLACEMENT TABLE RT2

| PARTIAL DOT DATA (BEFORE REPLACEMENT) | FIRST DOT DATA | SECOND DOT DATA |
|---|---|---|
| EXTRA-LARGE | LARGE | EXTRA-LARGE |
| LARGE | LARGE | LARGE |
| MEDIUM | NO DOT | MEDIUM |
| SMALL | NO DOT | SMALL |
| NO DOT | NO DOT | NO DOT |

FIG. 10B

SECOND EXEMPLARY EMBODIMENT

DRIVE WAVEFORM TABLE WT

| PIXEL VALUE | USUAL WAVEFORM | SPECIAL WAVEFORM |
|---|---|---|
| EXTRA-LARGE | WAVEFORM 5 | WAVEFORM 4 |
| LARGE | WAVEFORM 4 | WAVEFORM 3 |
| MEDIUM | WAVEFORM 2 | WAVEFORM 2 |
| SMALL | WAVEFORM 1 | WAVEFORM 1 |

FIG. 11A

SECOND EXEMPLARY EMBODIMENT

PARTIAL DOT DATA (BEFORE REPLACEMENT)

DI0

| | | | | | | | | | |
|---|---|---|---|---|---|---|---|---|---|
| L | S | S | M | | M | M | S | L | S |
| S | | L | | L | L | | | | M |
| M | | XL | | XL | XL | L | L | | S |
| M | L | L | L | L | L | XL | | L | S |
| M | | L | | L | XL | L | XL | L | S |
| L | L | L | XL | | XL | L | | L | XL |
| M | M | L | M | S | M | XL | M | L | M |

PX

PX1

PX2

PX3

PX4

FIG. 11B

SECOND EXEMPLARY EMBODIMENT

FIRST DOT DATA

DI1b

| | | | | | | | | | |
|---|---|---|---|---|---|---|---|---|---|
| L | | | | | | | | L | |
| | | L | | L | L | | | | |
| | | L | | L | L | L | L | | |
| | L | L | L | L | L | L | | L | |
| | | L | | L | L | L | L | L | |
| L | L | L | L | | L | L | | L | L |
| | | L | | | | L | | L | |

PX

PX1

PX2

PX3

PX4

FIG. 11C

SECOND EXEMPLARY EMBODIMENT

SECOND DOT DATA

DI2b

| | | | | | | | | | |
|---|---|---|---|---|---|---|---|---|---|
| L | S | S | M | | M | M | S | L | S |
| S | | L | | L | L | | | | M |
| M | | XL | | XL | XL | L | L | | S |
| M | L | L | L | L | L | XL | | L | S |
| M | | L | | L | XL | L | XL | L | S |
| L | L | L | XL | | XL | L | | L | XL |
| M | M | L | M | S | M | XL | M | L | M |

PX

PX1

PX2

PX3

PX4

FIG. 12A

SECOND EXEMPLARY EMBODIMENT

USUAL PARTIAL PRINTING

RI0

| | | | | | | | | | |
|---|---|---|---|---|---|---|---|---|---|
| 4 | 1 | 1 | 2 | | 2 | 2 | 1 | 4 | 1 |
| 1 | | 4 | | 4 | 4 | | | | 2 |
| 2 | | 5 | | 5 | 5 | 4 | 4 | | 1 |
| 2 | 4 | 4 | 4 | 4 | 4 | 5 | | 4 | 1 |
| 2 | | 4 | | 4 | 5 | 4 | 5 | 4 | 1 |
| 4 | 4 | 4 | 5 | | 5 | 4 | | 4 | 5 |
| 2 | 2 | 4 | 2 | 1 | 2 | 5 | 2 | 4 | 2 |

PX1 PX2 PX3 PX4 PX

FIG. 12B

SECOND EXEMPLARY EMBODIMENT

FIRST PARTIAL PRINTING (SPECIAL PARTIAL PRINTING)

RI1

| | | | | | | | | | |
|---|---|---|---|---|---|---|---|---|---|
| 3 | | | | | | | | 3 | |
| | | 3 | | 3 | 3 | | | | |
| | | 3 | | 3 | 3 | 3 | 3 | | |
| | 3 | 3 | 3 | 3 | 3 | 3 | | 3 | |
| | | 3 | | 3 | 3 | 3 | 3 | 3 | |
| 3 | 3 | 3 | 3 | | 3 | 3 | | 3 | 3 |
| | | 3 | | | | 3 | | 3 | |

PX1 PX2 PX3 PX4 PX

FIG. 12C

SECOND EXEMPLARY EMBODIMENT

SECOND PARTIAL PRINTING (SPECIAL PARTIAL PRINTING)

RI2

| | | | | | | | | | |
|---|---|---|---|---|---|---|---|---|---|
| 3 | 1 | 1 | 2 | | 2 | 2 | 1 | 3 | 1 |
| 1 | | 3 | | 3 | 3 | | | | 2 |
| 2 | | 4 | | 4 | 4 | 3 | 3 | | 1 |
| 2 | 3 | 3 | 3 | 3 | 3 | 4 | | 3 | 1 |
| 2 | | 3 | | 3 | 4 | 3 | 4 | 3 | 1 |
| 3 | 3 | 3 | 4 | | 4 | 3 | | 3 | 4 |
| 2 | 2 | 3 | 2 | 1 | 2 | 4 | 2 | 3 | 2 |

PX1 PX2 PX3 PX4 PX

IMAGE PROCESSING DEVICE, PRINTING APPARATUS, AND STORAGE MEDIUM

CROSS-REFERENCE TO RELATED APPLICATIONS

This application is based upon and claims the benefit of priority from prior Japanese patent application No. 2018-173136, filed on Sep. 15, 2018, the entire contents of which are incorporated herein by reference.

TECHNICAL FIELD

The present disclosure relates to image processing for a printing execution unit capable of forming a plurality of types of dots on a printing medium.

BACKGROUND ART

A printer configured to print an image by discharging ink from nozzles of a printing head has been known. In the printer, for example, when a temperature of the ink is relatively low, a viscosity of the ink is increased, so that delay in ink supply from an accommodation part of the ink to the printing head is likely to occur. When the delay in ink supply occurs, an image quality is deteriorated due to thinning of a print image, for example.

Related art discloses a technology of, when the number of continuous discharging of dots counted in a band is larger than a threshold value corresponding to a temperature of the printing head, increasing the number of passes to print the band.

However, according to the technology, when the number of passes to print the band is increased, an image quality of an image to be printed may be deteriorated.

SUMMARY

Aspects of the present disclosure discloses a technology capable of reducing delay in ink supply and also reducing deterioration in an image quality resulting from reducing the delay in the ink supply.

According to an aspect of the disclosure, there is provided an image processing device for a printing execution unit including: a printing head having a plurality of nozzles configured to discharge ink; an ink supply unit configured to supply the ink to the printing head; a main scanning unit configured to execute a main scanning in which the printing head is moved relative to a printing medium in a main scanning direction; and a sub-scanning unit configured to execute a sub-scanning in which the printing medium is moved relative to the printing head in a sub-scanning direction intersecting with the main scanning direction, the image processing device including: a controller configured to perform: acquiring image data; and causing the printing execution unit to perform printing by using the acquired image data, the printing being performed by executing, for a plurality of times, (i) partial printing in which the printing head is caused to discharge the ink while causing the main scanning unit to execute the main scanning and (ii) sub-scanning in which the sub-scanning unit is caused to execute the sub-scanning, wherein the printing execution unit is caused to perform the printing by: in a first case where a specific condition is not satisfied, printing a partial image by single partial printing, the partial image being a part of an image to be printed and corresponding to the partial printing, the specific condition being determined for each partial image, and the specific condition indicating that ink supply from the ink supply unit to the printing head may be delayed in the partial printing; in a second case where the specific condition is satisfied, printing the partial image by a plurality of partial printings including a first partial printing and a second partial printing; in the first case, forming a dot having a specific size by the single partial printing, as a dot corresponding to a specific pixel in the partial image; and in the second case, forming a dot having a size smaller than the specific size by the first partial printing and forming a dot having a size smaller than the specific size by the second partial printing, as the dot corresponding to the specific pixel.

According to the above configuration, in the second case where the specific condition is satisfied, the partial image is printed by the plurality of partial printings including the first partial printing and the second partial printing. Therefore, it is possible to reduce the delay in ink supply, as compared to a case where the partial image is printed by the single partial printing. Also, in the second case where the specific condition is satisfied, the dot corresponding to the specific pixel in the partial image is formed by both the first partial printing and the second partial printing. Therefore, a part in which dots are formed only by the first partial printing and a part in which dots are formed only by the second partial printing are reduced in an image to be printed. As a result, it is possible to reduce occurring of a failure that a boundary between the part in which the dots are formed only by the first partial printing and the part in which the dots are formed only by the second partial printing is noticeable. Therefore, while reducing the delay in ink supply, it is possible to reduce deterioration in an image quality resulting from reducing the delay in ink supply.

In the meantime, the technology of the present disclosure can be implemented in a variety of forms, such as a printing apparatus, a control method of the printing execution unit, a printing method, a storage medium having a computer program stored therein, and the like.

BRIEF DESCRIPTION OF DRAWINGS

FIGS. 7A and 7B depict an example of tables included in a control table group TG of the first exemplary embodiment;

FIGS. 10A and 10B depict an example of tables included in the control table group TG of the second exemplary embodiment;

FIGS. 11A to 11C is a first diagram illustrating partial printing of the second exemplary embodiment; and FIGS. 12A to 12C is a second diagram illustrating the partial printing of the second exemplary embodiment.

DESCRIPTION OF EMBODIMENTS

A. First Exemplary Embodiment

A-1: Configuration of Printer 200

Figure 1:
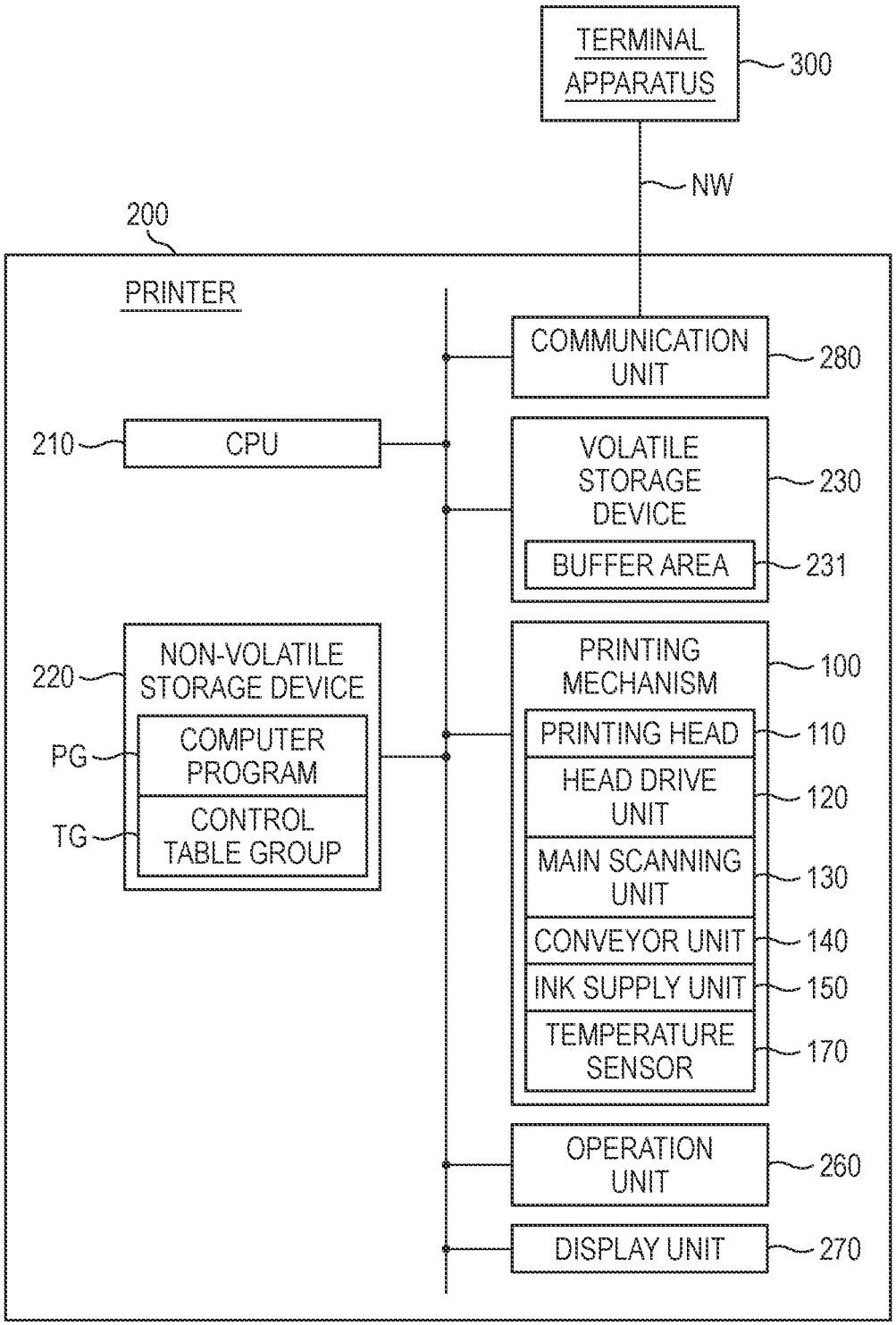
FIG. 1 is a block diagram depicting a configuration of a printer 200 of an exemplary embodiment.

Hereinafter, an exemplary embodiment is described. FIG. 1 is a block diagram depicting a configuration of a printer 200 of an exemplary embodiment.

The printer 200 includes, for example, a printing mechanism 100, a CPU 210 as a controller of the printer 200, a non-volatile storage device 220 such as a hard disk drive, a volatile storage device 230 such as a RAM, an operation unit 260 such as a button and a touch panel for acquiring a user's operation, a display unit 270 such as a liquid crystal monitor, and a communication unit 280. The communication unit 280 includes a wired or wireless interface for connecting to a network NW. The printer 200 is communicatively connected to an external apparatus, for example, a terminal apparatus 300 via the communication unit 280.

The volatile storage device 230 provides a buffer area 231 for temporarily storing therein a variety of intermediate data that are generated when the CPU 210 performs processing. In the non-volatile storage device 220, a computer program PG and a control table group TG are stored. In the first exemplary embodiment, the computer program PG is a control program for controlling the printer 200. The computer program PG and the control table group TG may be provided while being stored in the non-volatile storage device 220 upon shipment of the printer 200. Instead of this configuration, the computer program PG and the control table group TG may be downloaded from a server or may be provided in a state of being stored in a DVD-ROM and the like. The CPU 210 is configured to execute the computer program PG, thereby executing image processing to be described later, for example. Thereby, the CPU 210 controls the printing mechanism 100 to print an image on a printing medium (for example, sheet). The control table group TG is a table for determining a parameter to be used in the image processing. The control table group TG will be described later.

The printing mechanism 100 can form dots on a sheet M by using inks (ink droplets) of cyan (C), magenta (M), yellow (Y) and black (K), thereby performing color printing. The printing mechanism 100 includes a printing head 110, a head drive unit 120, a main scanning unit 130, a conveyor unit 140, an ink supply unit 150 and a temperature sensor 170.

Figure 2:
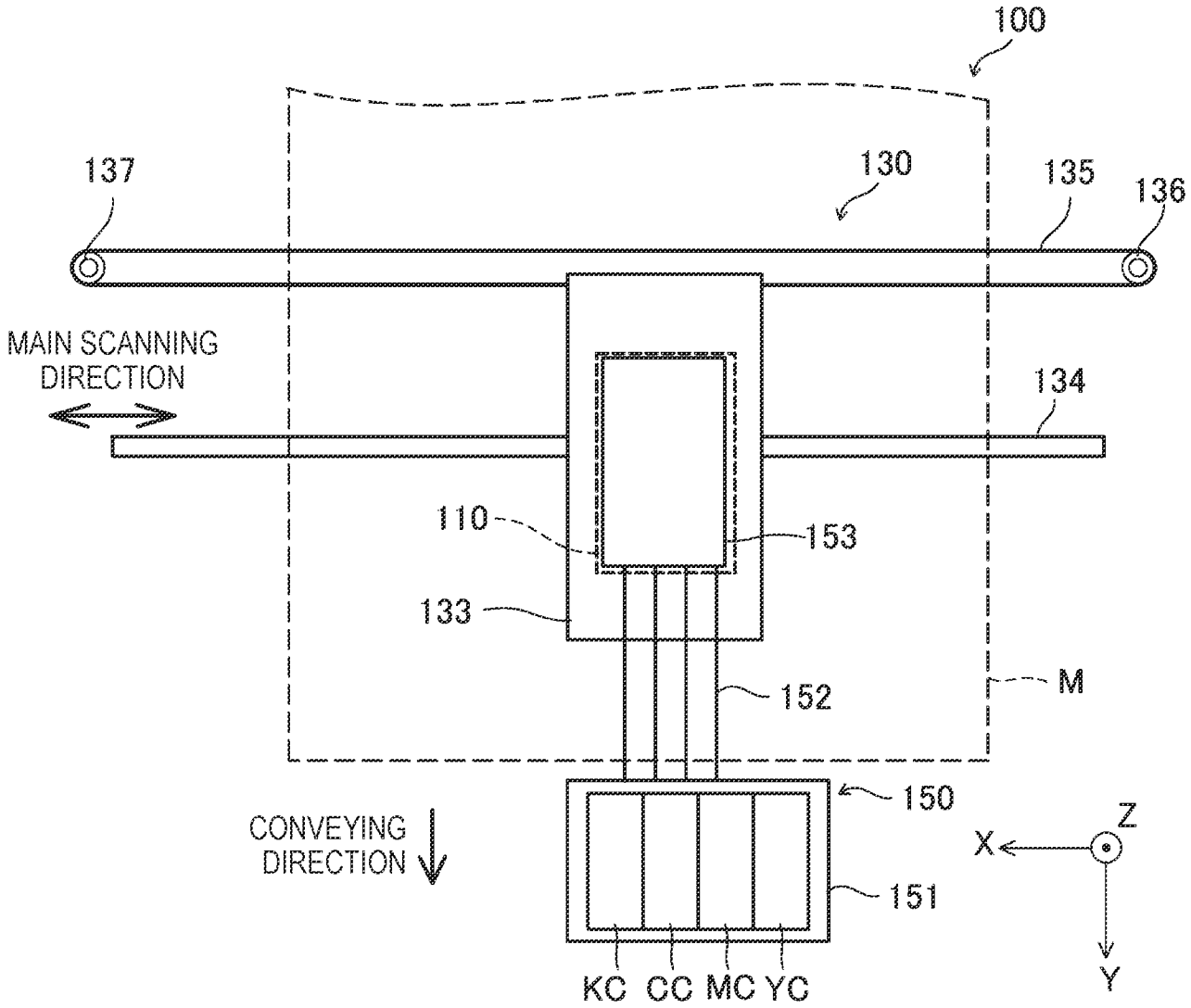
FIG. 2 depicts a schematic configuration of a printing mechanism 100.

FIG. 2 depicts a schematic configuration of the printing mechanism 100. As shown in FIG. 2, the main scanning unit 130 includes a carriage 133, a slide shaft 134, a belt 135, and a plurality of pulleys 136, 137. The carriage 133 is configured to mount thereon the printing head 110. The slide shaft 134 is configured to hold the carriage 133 to be reciprocally moveable in a main scanning direction (X-axis direction, in FIG. 2). The belt 135 is wound on the pulleys 136, 137, and a part thereof is fixed to the carriage 133. The pulley 136 is rotated by power of a main scanning motor (not shown). When the main scanning motor rotates the pulley 136, the carriage 133 moves along the slide shaft 134. Thereby, a main scanning of reciprocally moving the printing head 110 relative to the sheet M in the main scanning direction is implemented.

The conveyor unit 140 is configured to convey the sheet M in a conveying direction (+Y direction, in FIG. 2) while holding the sheet M. Hereinafter, an upstream side (−Y side) in the conveying direction is simply referred to as 'upstream side', and a downstream side (+Y side) in the conveying direction is simply referred to as 'downstream side'. Although not specifically shown, the conveyor unit 140 includes a pair of upstream rollers configured to hold the sheet M on a further upstream side than the printing head 110, a pair of downstream rollers configured to hold the sheet M on a further downstream side than the printing head 110, and a motor. The conveyor unit 140 is configured to convey the sheet M by driving the rollers with power of the motor.

The ink supply unit 150 is configured to supply ink to the printing head 110. The ink supply unit 150 includes a cartridge mounting unit 151, tubes 152, and a buffer tank 153. A plurality of ink cartridges KC, CC, MC, YC in which inks are accommodated is detachably mounted to the cartridge mounting unit 151, and the inks are supplied from the ink cartridges. The buffer tank 153 is arranged above the printing head 110 mounted to the carriage 133, and is configured to temporarily accommodate therein each ink of CMYK to be supplied to the printing head 110. The tube 152 is a flexible tube configured to interconnect the cartridge mounting unit 151 and the buffer tank 153 and becoming a flow path of the ink. The ink in each ink cartridge is supplied to the printing head 110 through the cartridge mounting unit 151, the tube 152 and the buffer tank 153. The buffer tank 153 is provided with a filter (not shown) for removing foreign matters mixed in the ink.

Figure 3:
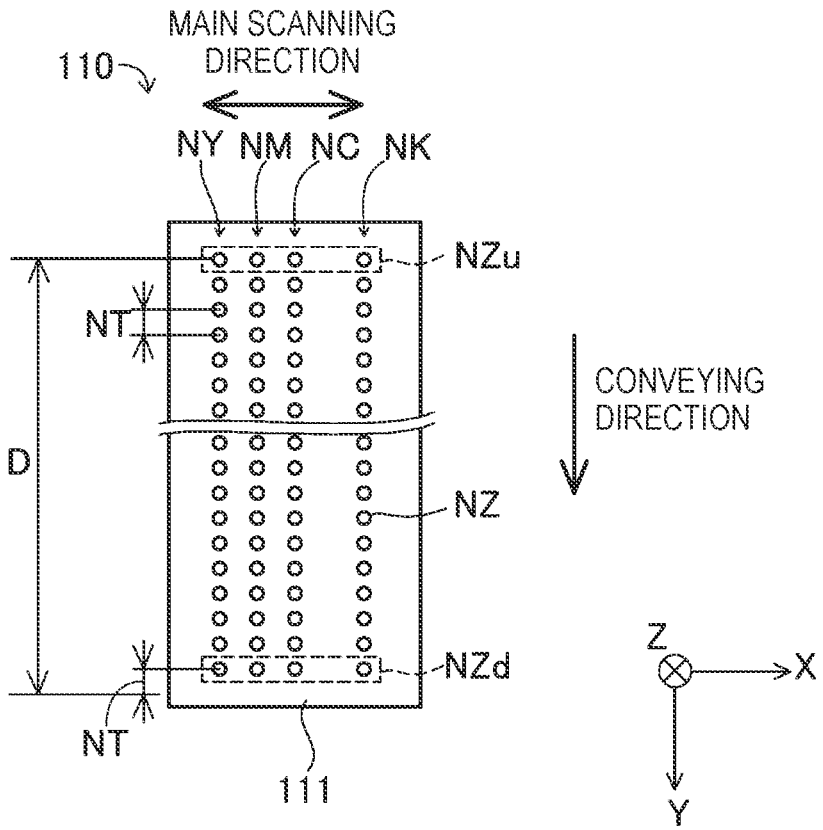
FIG. 3 depicts a configuration of a printing head 110, as seen from −Z side.

FIG. 3 depicts a configuration of the printing head 110, as seen from −Z side. As shown in FIG. 3, a nozzle formation surface 111 of the printing head 110 is a surface facing the sheet M to be conveyed by the conveyor unit 140. The nozzle formation surface 111 is formed with a plurality of nozzle rows consisting of a plurality of nozzles NZ, i.e., nozzle rows NC, NM, NY, NK for discharging the respective inks of C, M, Y and K. Each nozzle row includes a plurality of nozzles NZ. The plurality of nozzles NZ has positions different from each other in the conveying direction (+Y direction), and is aligned with predetermined nozzle intervals NT in the conveying direction. The nozzle interval NT is a length in the conveying direction between two nozzles NZ, which are adjacent to each other in the conveying direction, of the plurality of nozzles NZ. A nozzle NZ, which is located on the most upstream side (−Y side), of the nozzles configuring the nozzle row is referred to as the most upstream nozzle NZu. Also, a nozzle NZ, which is located on the most downstream side (+Y side), of the nozzles is referred to as the most downstream nozzle NZd. A length obtained by adding the nozzle interval NT to a length in the conveying direction from the most upstream nozzle NZu to the most downstream nozzle NZd is referred to as 'nozzle length D'.

Positions of the nozzle rows NC, NM, NY, NK in the main scanning direction are different, and positions thereof in a sub-scanning direction overlap each other. For example, in the example of FIG. 3, the nozzle row NM is arranged in the +X direction of the nozzle row NY for discharging the yellow (Y) ink.

Each nozzle NZ is connected to the buffer tank 153 through an ink flow path (not shown) formed in the printing head 110. Actuators (not shown, piezoelectric elements, in the first exemplary embodiment) for discharging the inks along the respective ink flow paths in the printing head 110 are provided.

The head drive unit 120 (FIG. 1) is configured to drive each actuator in the printing head 110, in accordance with printing data supplied from the CPU 210 during the main scanning by the main scanning unit 130. Thereby, the inks are discharged from the nozzles NZ of the printing head 110 onto the sheet M being conveyed by the conveyor unit 140, so that dots are formed. The configuration of the head drive unit 120 will be described later. The head drive unit 120 can form a plurality of sizes of dots on the sheet M by changing a drive voltage to be supplied to the actuators. Specifically, the head drive unit 120 can form four types of dots "small (S)", "medium (M)", "large (L)" and "extra-large (XL)".

The temperature sensor 170 is a well-known temperature sensor including a temperature measurement resistance member and the like, and is provided in the vicinity of the printing head 110 of the printer 200. The temperature sensor 170 is configured to output a signal indicative of a temperature of the printing head 110 of the printer 200.

A-2. Outline of Printing

The CPU 210 is configured to print a print image on the sheet M by alternately executing, for a plurality of times, partial printing of causing the printing head 110 to discharge the inks to form dots on the sheet M while causing the main scanning unit 130 to execute the main scanning, and a sub-scanning (conveyance of the sheet M) by the conveyor unit 140.

Figure 4:
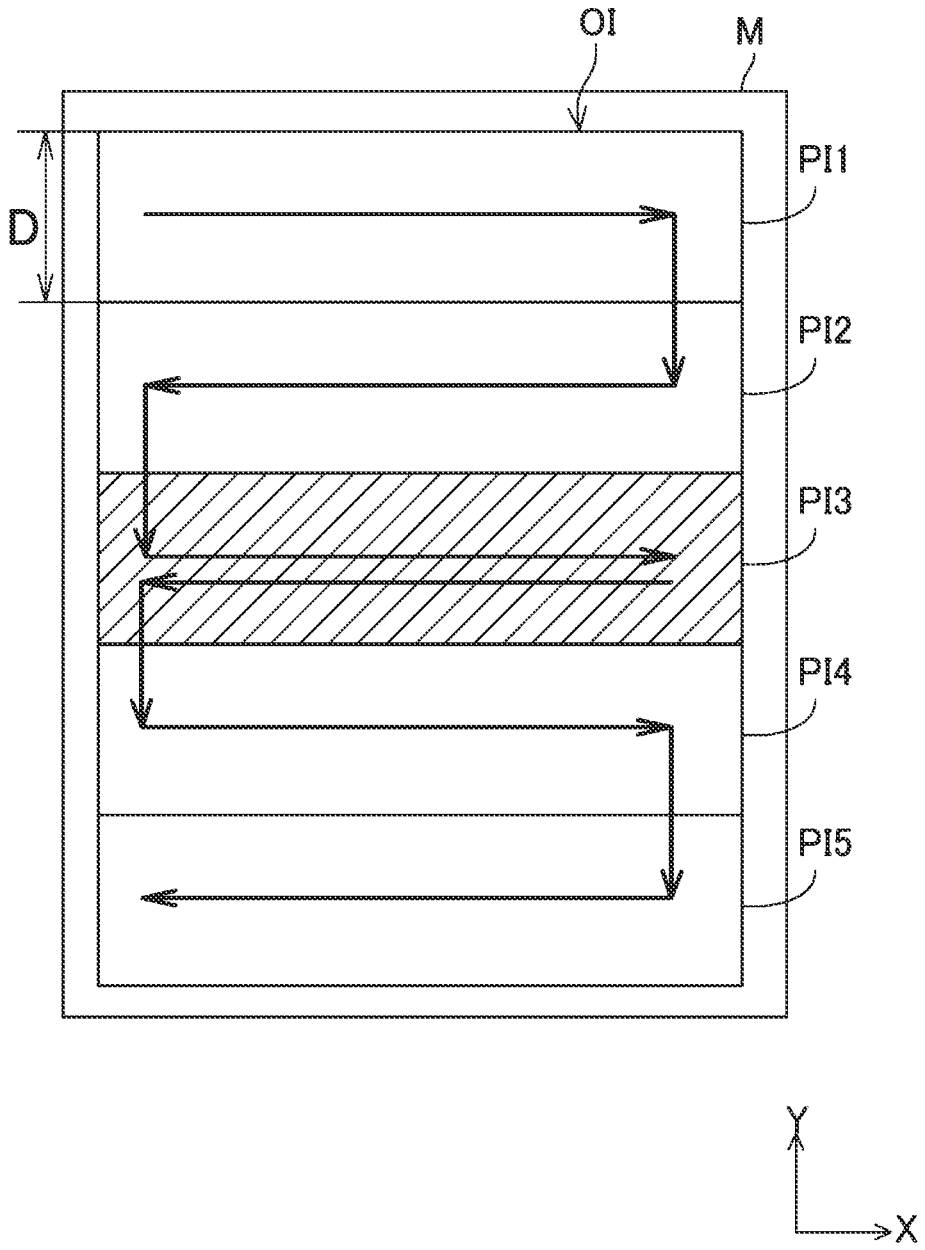
FIG. 4 illustrates operations of the printing mechanism 100.

FIG. 4 illustrates operations of the printing mechanism 100. In FIG. 4, a print image OI to be printed on the sheet M is shown. The print image OI includes a plurality of partial images PI1 to PI5. Each partial image is, in principle, an image to be printed by single partial printing. Although described in detail later, one partial image may be printed by two partial printings. A printing direction of the partial printing is one of a forward direction and a backward direction. That is, the partial printing is one of forward printing of forming dots while performing the main scanning in the forward direction (+X direction in FIG. 4) and backward printing of forming dots while performing the main scanning in the backward direction (−X direction in FIG. 4).

In the partial image of FIG. 4, at least one arrow in the +X direction or the −X direction is shown. The partial images PI1, PI4 denoted with one arrow in the +X direction are forward partial images printed by one forward printing. The partial images PI2, PI5 denoted with one arrow in the −X direction are backward partial images printed by one backward printing. The hatched partial image PI3 is denoted with two arrows in the +X direction and the −X direction. The partial image PI3 is a reciprocal partial image to be printed by two partial printings including single forward printing and single backward printing.

As shown in FIG. 4, the printing of the first exemplary embodiment is bidirectional printing in which the forward printing and the backward printing are alternately executed. The bidirectional printing can shorten printing time, as compared to unidirectional printing in which only the forward printing is to be repeatedly executed, for example. In the unidirectional printing, since the forward printing is again executed after the forward printing, it is necessary to move the printing head 110 in the backward direction without executing the partial printing. However, it is not necessary to perform such operation in the bidirectional printing.

In FIG. 4, the arrow in the −Y direction facing from one partial image (for example, the partial image PI1) toward another partial image (for example, the partial image PI2) adjacent thereto in the −Y direction corresponds to the conveyance (sub-scanning) of the sheet M. That is, in FIG. 4, the arrow in the −Y direction indicates that the sheet M is conveyed and the printing head 110 is thus moved relative to the sheet M shown in FIG. 4 in the −Y direction. As shown in FIG. 4, the printing of the first exemplary embodiment is in principle so-called one pass printing, and a length of each partial image in the conveying direction and a single conveying amount of the sheet M are the nozzle length D. In the meantime, like the partial image PI3, in a specific case, a partial image may be printed by two partial printings (which will be described in detail later).

Here, when the ink is discharged from the nozzles NZ during the printing, the ink is reduced in the buffer tank 153 (FIG. 2) by a discharged amount of the ink, so that a negative pressure is generated in the buffer tank 153. By the negative pressure, the ink is supplied from the ink cartridge to the buffer tank 153 through the cartridge mounting unit 151 and the tube 152. When a large amount of ink is discharged from the plurality of nozzles NZ in a short time for printing, the ink supply to the buffer tank 153 may be delayed. When the delay in ink supply occurs, even though the actuator is actuated, a failure that the ink is not discharged from the nozzles NZ or a failure that a smaller amount of ink than expected is discharged occurs. When such failure occurs, a color is thinned and an image quality is thus degraded in the print image OI.

The delay in ink supply is likely to occur when flowability of the ink is lowered. For example, the lower a temperature (hereinafter, also referred to as 'head temperature Th') of the printing head 110 of the printer 200 (the printing mechanism 100) is, the more the delay in ink supply is likely to occur. The reason is that as the head temperature Th is lowered, a viscosity of the ink is increased, resulting in a decrease in flowability of the ink. Here, a cumulative-use amount TA of ink is an index value indicative of a cumulative-use amount of a specific ink (any one of C, M, Y and K) up to now since the manufacturing of the printer 200. The larger the cumulative-use amount TA of ink is, the more the delay of specific ink supply is likely to occur. The reason is that as the cumulative-use amount TA of ink increases, an accumulation amount of foreign matters in a filter for removing the foreign matters in the ink increases, resulting in an increase in flow path resistance of the ink and a decrease in flowability of the ink. Also, a pass-use amount PA of ink is an index value indicative of a use amount of the specific ink to be used for partial image printing in the single partial printing. The larger the pass-use amount PA of ink is, the more the delay of specific ink supply is likely to occur. The reason is that since the specific ink is used in a short time, the specific ink supply cannot keep up with the use amount.

In image processing to be described below, a scheme for reducing the delay in ink supply is made. Specifically, when printing a specific partial image (the partial image PI3, in the example of FIG. 4) in which a specific condition, which indicates that the delay in ink supply is likely to occur, is satisfied, the specific partial image is printed by the two partial printings, as described above. Thereby, as compared to a case where the specific partial image is printed by single partial printing, it is possible to reduce an amount of ink to be used per one partial printing. Therefore, since it is possible to reduce a large amount of ink from being used in a short time when printing the specific partial image, it is possible to reduce the delay in ink supply when printing the specific partial image.

A-3. Image Processing

Figure 5:
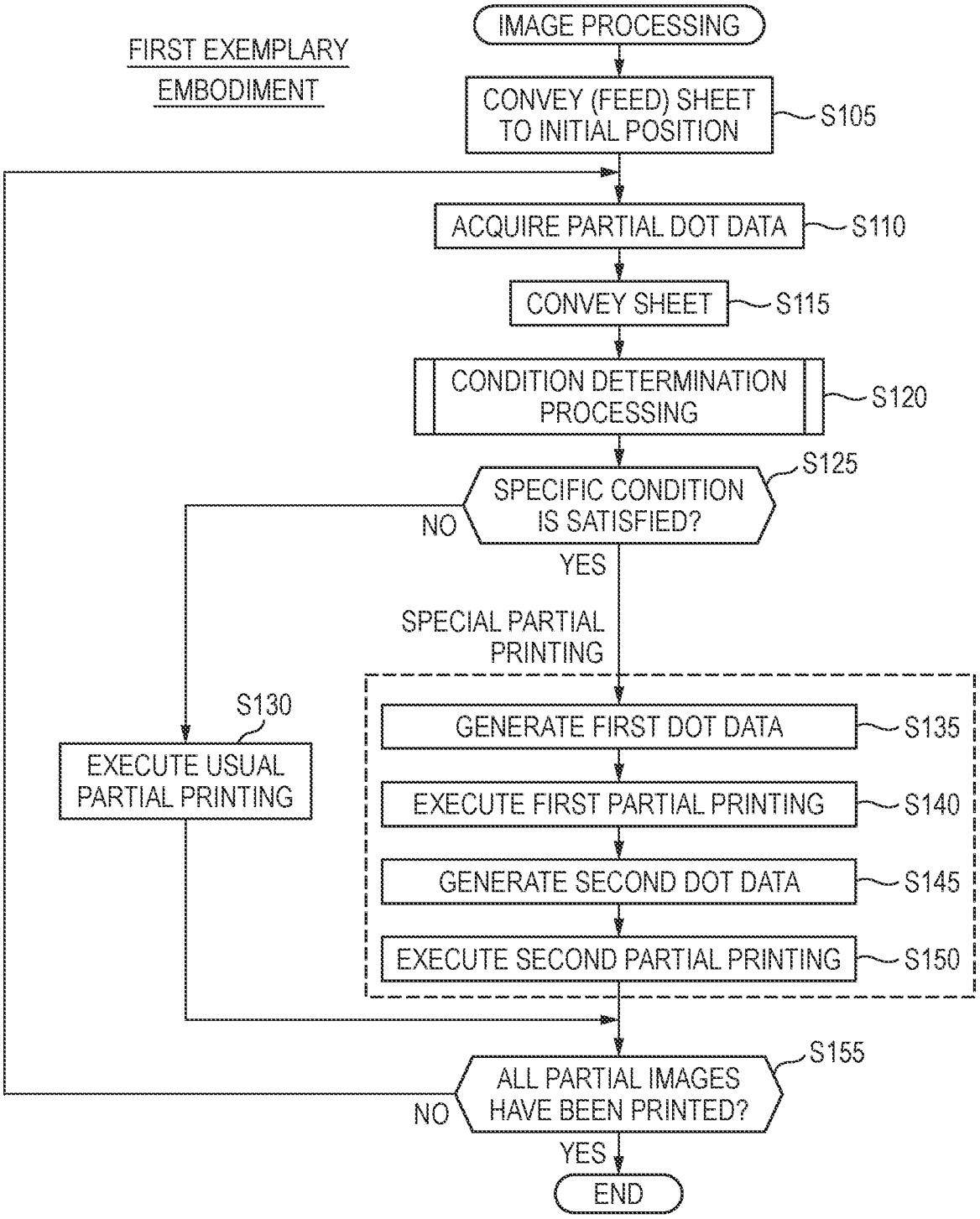
FIG. 5 is a flowchart of image processing of a first exemplary embodiment.

FIG. 5 is a flowchart of image processing of the first exemplary embodiment. When the CPU 210 of the printer 200 receives a printing instruction from the terminal apparatus 300 (FIG. 1), for example, the CPU 210 starts the image processing. Instead of this configuration, the CPU 210 may start the image processing when a printing instruction is acquired from a user through the operation unit 260. The printing instruction includes a designation of image data indicative of an image to be printed.

In S105, the CPU 210 controls the conveyor unit 140 to convey (feed) one sheet M from a print tray (not shown) to a predetermined initial position.

In S110, the CPU 210 acquires partial dot data, which corresponds to a partial image to be printed by the single partial printing, as notice partial dot data, and stores the same in the buffer area 331. For example, the CPU 210 acquires the notice partial dot data by receiving the notice partial dot data from the terminal apparatus 300. In the first exemplary embodiment, the notice partial dot data is data (dot data) indicative of a formation state of dot for each color component and for each pixel. In the first exemplary embodiment, the formation state of dot is any one of "extra-large dot", "large dot", "medium dot", "small dot" and "no dot". Meanwhile, in a modified embodiment, the CPU 210 may generate the notice partial dot data by using the image data stored in the volatile storage device 230, thereby acquiring the notice partial dot data. In this case, for example, generation processing including color conversion processing and halftone processing is executed for partial image data, which corresponds to the partial image, of the image data, so that the notice partial dot data is generated.

Here, the partial image corresponding to the notice partial dot data is also referred to as 'notice partial image'. Also, the partial printing for printing the notice partial image is also referred to as 'notice partial printing'.

In S115, the CPU 210 controls the conveyor unit 140 to convey the sheet M so that a position of the printing head 110 relative to the sheet M in the conveying direction is to be a position in which the notice partial image is to be printed. For example, when the second partial printing and thereafter is the notice partial printing, the sheet M is conveyed by the nozzle length D, as can be seen from FIG. 4.

In S120, the CPU 210 executes condition determination processing. The condition determination processing is processing of determining whether a specific condition, which indicates that the ink supply from the ink supply unit 150 to the printing head 110 in the notice partial printing may be delayed, is satisfied.

Figure 6:
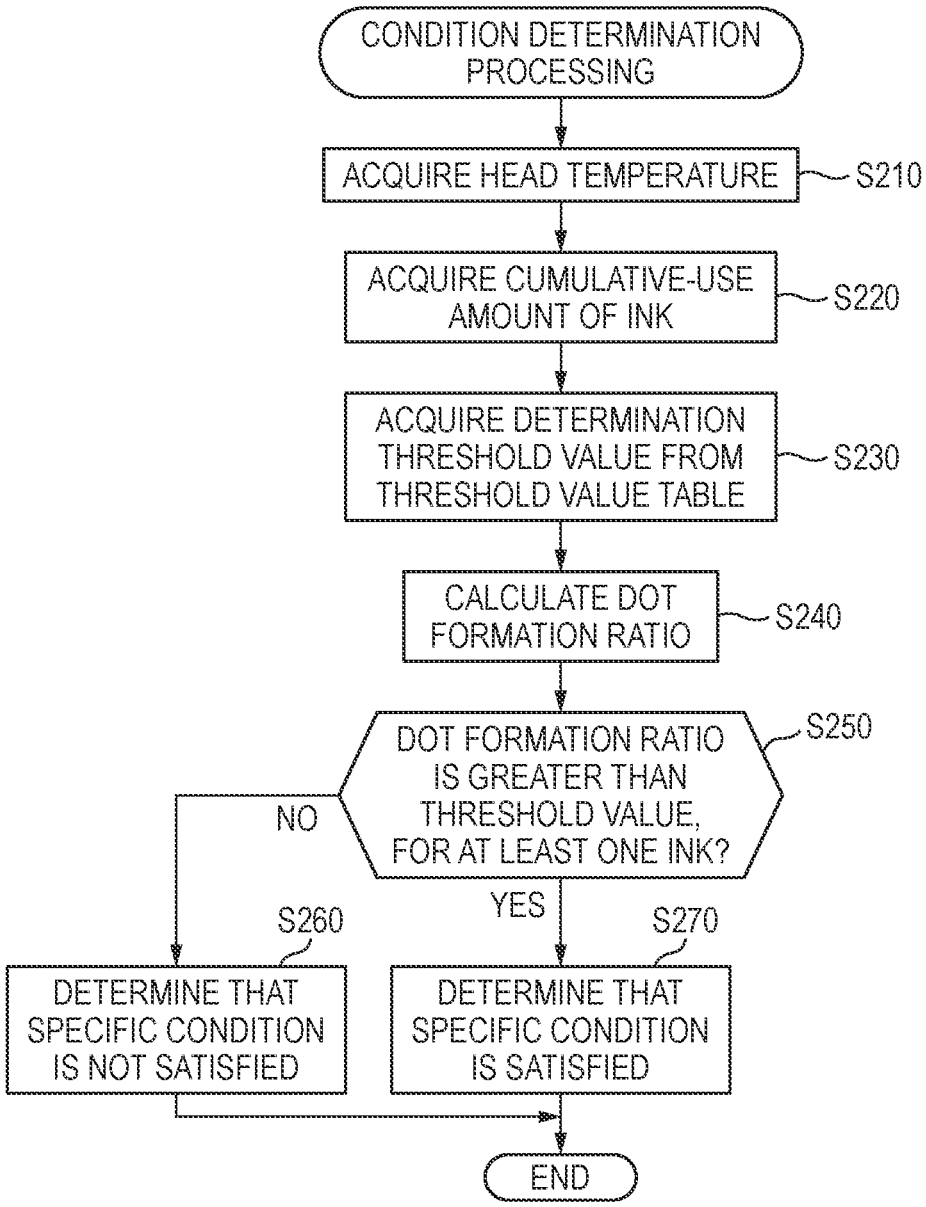
FIG. 6 is a flowchart of condition determination processing.

FIG. 6 is a flowchart of the condition determination processing. FIGS. 7A and 7B depict an example of tables included in a control table group TG (FIG. 1) of the first exemplary embodiment. When the condition determination processing is initiated, in S210, the CPU 210 acquires a head temperature Th of the printing head 110 of the printer 200, based on a signal from the temperature sensor 170.

In S220, the CPU 210 acquires the cumulative-use amount TA of each ink to be used for printing from the non-volatile storage device 220. The cumulative-use amount TA of ink is recorded for each ink of CMYK in a predetermined area of the non-volatile storage device 220. The CPU 210 calculates a use amount of ink of each color based on the number of dots formed by the printing and updates the cumulative-use amount TA of ink whenever executing the printing, for example. In S220, for example, in the case of monochrome printing, the cumulative-use amount TA of black (K) ink is acquired, and in the case of color printing, the cumulative-use amount TA of each ink of CMYK is acquired.

In S230, the CPU 210 acquires, based on the head temperature Th and the cumulative-use amount TA of ink, a determination threshold value JT corresponding to each ink to be used for printing, from a threshold value table TT. FIG. 7A depicts an example of the threshold value table TT. In the threshold value table TT, determination threshold values JT are recorded in correspondence to combinations of the head temperature Th and the cumulative-use amount TA of ink. For example, in FIG. 7A, when the acquired head temperature Th is within a preset range "medium" and the cumulative-use amount TA of ink acquired for specific ink is within a preset range "large", 75% is acquired as the determination threshold value JT corresponding to the specific ink. In the case of the monochrome printing, the determination threshold value JT corresponding to the black (K) ink is acquired, and in the case of the color printing, the determination threshold value JT corresponding to each ink of CMYK is acquired.

As shown in FIG. 7A, in the threshold value table TT, the larger the cumulative-use amount TA of ink is, the smaller the determination threshold value JT is. Also, the lower the head temperature Th is, the smaller the determination threshold value JT is.

In S240, the CPU 210 calculates a dot formation ratio DR of each ink to be used for printing by using the notice partial image data. The dot formation ratio DR is calculated as follows. For example, a use amount of ink per one dot of "extra-large dot", "large dot", "medium dot" and "small dot" is set to 30 pl (picoliter), 20 pl, 10 pl and 5 pl, respectively. The CPU 210 calculates the numbers Nbb, Nb, Nm, Ns of respective formed dots of "extra-large dot", "large dot", "medium dot" and "small dot". The CPU 210 calculates, as a use amount IV of ink of the notice partial image, a sum of values obtained by multiplying the use amount of ink per one dot by each of the numbers Nbb, Nb, Nm, Ns of dots having respective sizes ($IV=(30\times Nbb)+(20\times Nb)+(10\times Nm)+(5\times Ns)$). The CPU 210 calculates the dot formation ratio DR by dividing the use amount IV of ink by a maximum value IVmax of the use amount IV of ink and multiplying a resultant value by 100 ($DR=(IV/IVmax)\times 100$). The maximum value IVmax is a value obtained by multiplying the use amount (30 pl) of ink per one extra-large dot by a total number TN of pixels of the notice partial image ($IVmax=30\times TN$). The dot formation ratio DR can be said as an index value indicating a dot formation degree when a state in which the extra-large dots are formed in all pixels in the notice partial image is set to 100% and a state in which no dot is formed in all pixels in the notice partial image is set to 0%. The greater the dot formation ratio DR of the specific ink is, the pass-use amount PA of the specific ink increases. Therefore, it can be said that the dot formation ratio DR is an index value indicative of the pass-use amount PA of ink. In the case of the monochrome printing, the dot formation ratio DR corresponding to the black (K) ink is calculated, and in the case of the color printing, the dot formation ratio DR corresponding to each ink of CMYK is calculated.

In S250, the CPU 210 determines whether the dot formation ratio DR is greater than the determination threshold value JT, for at least one ink to be used for printing. When it is determined that the dot formation ratio DR is greater than the determination threshold value JT, a large amount of ink is discharged in a short time, so that the delay in ink supply may occur. For this reason, when it is determined for at least one ink to be used for printing that the dot formation ratio DR is greater than the determination threshold value JT (S250: YES), the CPU 210 determines in S270 that the specific condition is satisfied. When it is determined for all inks to be used for printing that the dot formation ratio DR is equal to or smaller than the determination threshold value JT (S250: NO), the CPU 210 determines in S260 that the specific condition is not satisfied. When the determination as to whether the specific condition is satisfied is made, the condition determination processing is over.

When the condition determination processing is over, it is determined in S125 of FIG. 5 whether it has been determined in the condition determination processing that the specific condition is satisfied. When it is determined that the specific condition is not satisfied (S125: NO), the CPU 210 controls the main scanning unit 130 and the printing head 110 of the printing mechanism 100 by using the partial dot data, thereby executing usual partial printing, in S130. In the usual partial printing, single partial printing is performed. When previous partial printing is the forward printing, the backward printing is performed, and when the previous partial printing is the backward printing, the forward printing is performed. Thereby, the notice partial image is printed on the sheet M.

Figure 8A:
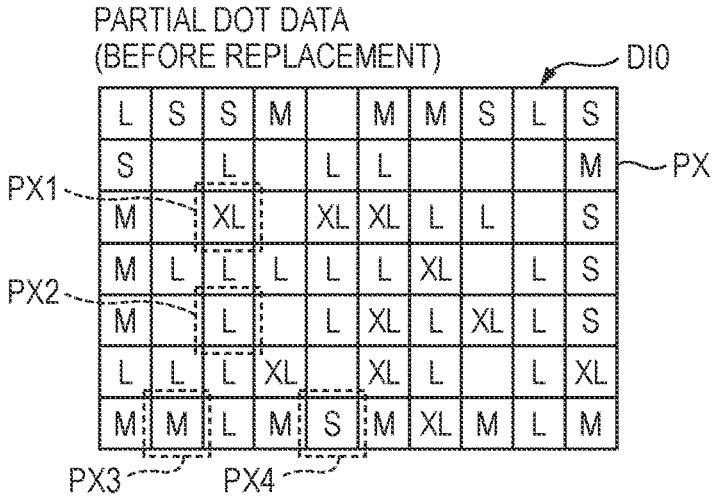
FIGS. 8A to 8C illustrate partial printing of the first exemplary embodiment.
Figure 8B:
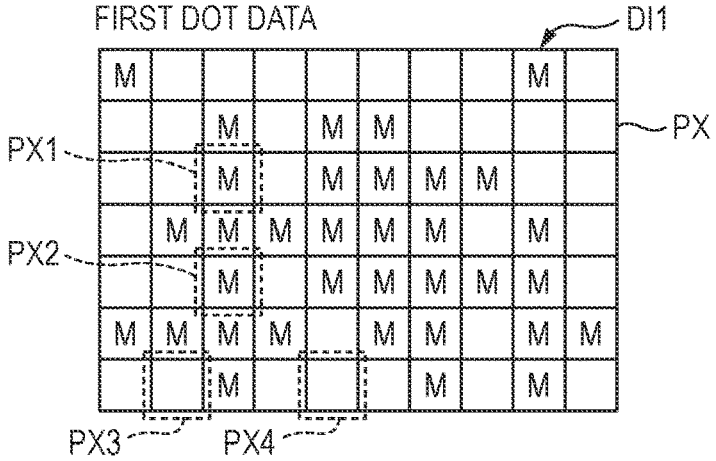
Figure 8C:
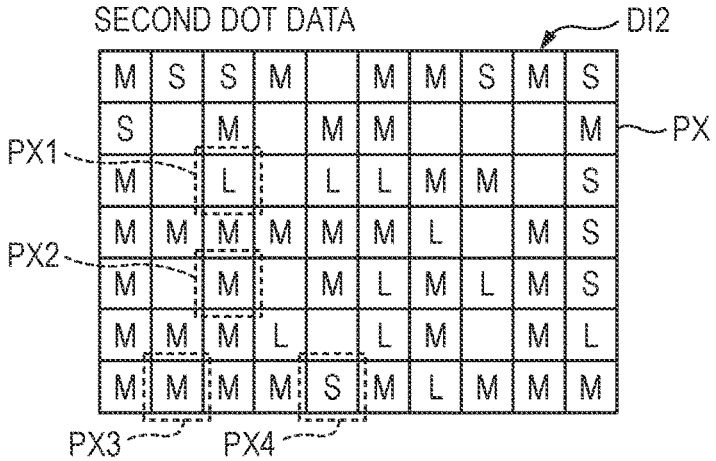

FIGS. 8A to 8C illustrate the partial printing of the first exemplary embodiment. In FIG. 8A, a dot image (also referred to as 'original dot image') DI0 based on the partial dot data is shown. In the usual partial printing, the original dot image DI0 based on the notice partial dot data is printed as the notice partial image, as it is. In the dot image DI0, a plurality of rectangles aligned in a matrix shape indicates pixels PX. Characters "S", "M", "L" and "XL" in the respective pixels PX indicate that the small dot, the medium dot, the large dot and the extra-large dot are arranged at positions corresponding to the respective pixels. The empty pixel PX indicates that no dot corresponding to the pixel PX is arranged. This applies to dot images DI1, DI2 of FIGS. 8B and 8C, too, which will be described later.

When it is determined that the specific condition is satisfied (S125: YES), the CPU 210 executes special partial printing in S135 to S150. In the special partial printing, the notice partial image is printed on the sheet by two partial printings.

In S135, the CPU 210 generates first dot data by using the notice partial dot data, with reference to a replacement table RT. FIG. 7B depicts an example of the replacement table RT. In the replacement table RT, a replacement rule for generating first dot data and second dot data is defined. In FIG. 8B, a first dot image DI1 based on the first dot data is shown. As can be seen from FIG. 8B and the replacement table RT, the first dot image DI1 is an image obtained by deleting the medium dot and the small dot in the pixels of the original dot image DI0, in which the medium dot and the small dot are arranged, and replacing the extra-large dot and the large dot in the pixels of the original dot image DI0, in which the extra-large dot and the large dot are arranged, with the medium dot. The CPU 210 replaces a pixel value, which indicates formation of the medium dot of the notice partial dot data, and a pixel value, which indicates formation of the small dot, with a pixel value indicating that no dot is formed. Also, the CPU 210 replaces a pixel value, which indicates formation of the extra-large dot of the notice partial dot data, and a pixel value, which indicates formation of the large dot, with the pixel value, which indicates formation of the medium dot. Thereby, the first dot data is generated.

In S140, the CPU 210 controls the main scanning unit 130 and the printing head 110 of the printing mechanism 100 by using the first dot data, thereby executing first partial printing. When the previous partial printing is the forward printing, the backward printing is executed as the first partial printing, and when the previous partial printing is the backward printing, the forward printing is executed as the first partial printing. Thereby, the first dot image DI1 (FIG. 8B), which configures a part of the notice partial image to be printed, is printed on the sheet M.

In S145, the CPU 210 generates second dot data by using the notice partial dot data, with reference to the replacement table RT. FIG. 8C depicts a second dot image DI2 based on the second dot data. As can be seen from FIG. 8C and the replacement table RT, the second dot image DI2 is an image obtained by replacing the extra-large dot in the pixel of the original dot image DI0, in which the extra-large dot is arranged, with the large dot, and replacing the large dot in the pixel of the original dot image DI0, in which the large dot is arranged, with the medium dot. In the dot image DI2, the medium dot and the small dot of the original dot image DI0 are kept, as they are. The CPU 210 replaces the pixel value, which indicates formation of the extra-large dot of the notice partial dot data, with the pixel value, which indicates formation of the large dot, and replaces the pixel value, which indicates formation of the large dot, with the pixel value, which indicates formation of the medium dot. Thereby, the second dot data is generated.

In S150, the CPU 210 controls the main scanning unit 130 and the printing head 110 of the printing mechanism 100 by using the second dot data, thereby executing second partial printing. When the first partial printing is the forward printing, the backward printing is executed as the second partial printing, and when the first partial printing is the backward printing, the forward printing is executed as the second partial printing. Thereby, the second dot image DI2 (FIG. 8C), which configures a part of the notice partial image to be printed, is printed on the sheet M.

Here, the sheet M is not conveyed between the first partial printing in S140 and the second partial printing in S150. As a result, the dot image DI1 and the dot image DI2 are printed with being superimposed in the same area on the sheet M. An image in which the dot image DI1 and the dot image DI2 are superimposed is printed on the sheet M, as the notice partial image.

As can be seen from the above descriptions, in the special partial printing of the first exemplary embodiment, the medium dot is formed by the first partial printing and the large dot is formed by the second partial printing at the position on the sheet M at which the extra-large dot is to be formed in a case where the notice partial printing is performed by the usual partial printing. Likewise, in the special partial printing, the medium dot is formed by the first partial printing and the medium dot is formed by the second partial printing at the position on the sheet M at which the large dot is to be formed in a case where the notice partial printing is performed by the usual partial printing. In the special partial printing of the first exemplary embodiment, no dot is formed by the first partial printing and the small dot or the medium dot is formed by the second partial printing at the position on the sheet M at which the small dot or the medium dot is to be formed in a case where the notice partial printing is performed by the usual partial printing.

In S155, the CPU 210 determines whether all partial images of an image to be printed have been printed. When it is determined that all the partial images have been printed (S155: YES), the CPU 210 ends the image processing. When it is determined that there is a partial image not printed yet (S155: NO), the CPU 210 returns to S110.

According to the first exemplary embodiment, it is determined for each partial image of an image to be printed whether the specific condition, which indicates that the ink supply may be delayed, is satisfied (S120 in FIG. 5). In the usual partial printing that is executed when the specific condition is not satisfied, the notice partial image is printed by the single partial printing (S130 in FIG. 5), and in the special partial printing that is executed when the specific condition is satisfied, the notice partial image is printed by the two partial printings including the first partial printing and the second partial printing (S135 to S150 in FIG. 5). In the usual partial printing, the extra-large dot is formed as the dot corresponding to the specific pixel PX1 in the notice partial image (FIG. 8A). In the special partial printing, the medium dot smaller than the extra-large dot is formed by the first partial printing and the large dot smaller than the extra-large dot is formed by the second partial printing, as the dot corresponding to the specific pixel PX1 (FIGS. 8B and 8C). Also, in the usual partial printing, the large dot corresponding to the specific pixel PX2 is formed (FIG. 8A). In the special partial printing, the medium dot smaller than the large dot is formed by the first partial printing and the medium dot smaller than the large dot is formed by the second partial printing, as the dot corresponding to the specific pixel PX2 (FIGS. 8B and 8C).

In this way, when the specific condition, which indicates that the ink supply may be delayed, is satisfied, the partial image is printed by the first partial printing and the second partial printing, so that it is possible to reduce the delay in ink supply as compared to a case where the partial image is printed by the single partial printing. The reason is that the amount of ink to be used in a short time is reduced. Also, when the specific condition is satisfied, the dots corresponding to the specific pixels (for example, the pixels PX1 and PX2) in the partial image are printed by both the first partial printing and the second partial printing. Therefore, for example, as compared to a case where the notice partial image is printed by simple two-pass printing, a part in which the dots are to be formed only by the first partial printing and a part in which the dots are to be formed only by the second partial printing are reduced in the print image OI. As a result, it is possible to reduce a failure that a boundary between the part in which the dots are to be formed only by the first partial printing and the part in which the dots are to be formed only by the second partial printing is noticeable. Therefore, while reducing the delay in ink supply, it is possible to reduce deterioration in an image quality resulting from reducing the delay in ink supply.

For example, in the simple two-pass printing, dots are formed in some of pixels, in which dots are to be formed, by the first partial printing, and dots are formed in the other pixels of the pixels, in which dots are to be formed, by the second partial printing. In this case, it is assumed that positions of the dots formed by the second partial printing deviate from positions of the dots formed by the first partial printing due to a conveyance error, an error of the main scanning, and the like. In this case, since the part in which the dots are to be formed only by the second partial printing deviates from the part in which the dots are to be formed only by the first partial printing, the boundary therebetween may be noticeable. However, according to the first exemplary embodiment, it is possible to reduce such failure.

In the first exemplary embodiment, in the pixels, which correspond to the pixels of the original dot image DI0 in which the extra-large dot and the large dot are arranged, of the plurality of pixels of the two dot images DI1, DI2 printed by the special partial printing, the dots are arranged in both the dot images DI1, DI2 (FIGS. 8A to 8C). In the pixels, which correspond to the pixels of the original dot image DI0 in which the medium dot and the small dot are arranged, of the plurality of pixels of the two dot images DI1, DI2 printed by the special partial printing, the dots are arranged in only the second dot image DI2 and no dot is arranged in the first dot image DR (FIGS. 8A to 8C). That is, in the special partial printing of the first exemplary embodiment, although the positions, at which the dots are to be formed by both the first partial printing and the second partial printing, of a plurality of positions (positions at which dots can be formed) on the sheet M corresponding to the plurality of pixels of the partial dot data and positions, at which dots are to be formed only by the second partial printing, are present, positions at which dots are to be formed only by the first partial printing are not present. Therefore, even in the case that the positions of dots formed by the second partial printing deviate from dots formed by the first partial printing, since the part in which the dots are to be formed only by the first partial printing is not present, it can be seen that the failure that the boundary is noticeable is difficult to occur.

Here, in the first exemplary embodiment, when two medium dots are formed at the specific position on the sheet M, the two medium dots superimposed on each other become a dot having an area equivalent to one large dot. Also, when one large dot and one medium dot are formed at the specific position on the sheet M, the dots superimposed on each other become a dot having an area equivalent to one extra-large dot. For this reason, the partial image, which is printed by using the specific partial dot data by the usual partial printing, and the partial image, which is printed by using the specific partial dot data by the special partial printing, can express images having substantially the same densities. As a result, it is possible to reduce a situation in which a density of an image to be printed is changed to deteriorate an image quality as a result of reducing the delay in ink supply, for example.

Also, according to the first exemplary embodiment, in the usual partial printing, the extra-large dot is formed by the single partial printing, as the dot corresponding to the pixel for which the formation of extra-large dot by the notice partial dot data is defined. In contrast, in the special partial printing, the medium dot smaller than the extra-large dot is formed by the first partial printing and the large dot smaller than the extra-large dot is formed by the second partial printing, as the dot corresponding to the pixel for which the formation of extra-large dot by the notice partial dot data is defined. As a result, it is possible to appropriately execute the two partial printings, based on the notice partial dot data.

More specifically, in the usual partial printing, the single partial printing is executed using the partial dot data (S130 in FIG. 5). In the special partial printing, the first dot data and the second dot data are generated by changing the specific pixel values (the pixel values indicating the formations of the extra-large dot and the large dot) of the partial dot data to values indicating formation of a smaller dot (S135 and S140 in FIG. 5). As a result, by generating the first dot data and the second dot data by changing the specific pixel values, the first partial printing and the second partial printing can be executed.

Also, according to the first exemplary embodiment, in the special partial printing, as the dot corresponding to the specific pixel PX1 for which the formation of the extra-large dot is defined in the partial dot data, the medium dot is formed by the first partial printing to be executed first, and the large dot is formed by the second partial printing to be executed later. Also, as the dot corresponding to the specific pixel PX2 for which the formation of the large dot is defined in the partial dot data, the medium dot is formed by both the first partial printing and the second partial printing. In this way, in the special partial printing, the dot having a first size smaller than a specific size defined in the partial dot data is formed by the first partial printing, and the dot having a second size smaller than the specific size and equal to or larger than the first size is formed by the second partial printing. When printing the same area by the two partial printings, the ink attached by the first partial printing of first time permeates into the sheet M, so that the sheet M may be partially extended and deformed. For example, the sheet M may be deformed to approach the printing head 110. In this state, when the second partial printing of second time is executed, the sheet M may contact the nozzle formation surface 111 of the printing head 110. In this case, the sheet M may be smudged or the nozzles NZ on the nozzle formation surface 111 may be damaged. Also, a distance between the nozzle formation surface 111 and the sheet M becomes shorter than expected, so that a spotting position of ink discharged in the second partial printing becomes different from an expected position. As a result, an image quality of an image to be printed may be deteriorated. For this reason, it is preferable to reduce the deformation of the sheet M after the first partial printing by reducing the amount of ink discharged in the first partial printing as much as possible. If the large dot is formed by the first partial printing and the medium dot is formed by the second partial printing, as the dot corresponding to the pixel PX1, an amount of ink discharged in the first partial printing becomes larger than an amount of ink discharged in the second partial printing, so that it may not be possible to reduce the deformation of the sheet M after the first partial printing. However, according to the first exemplary embodiment, since the amount of ink discharged in the first partial printing is equal to or smaller than the amount of ink discharged in the second partial printing, it is possible to reduce the above failures.

According to the above configuration, the amount of ink to be discharged in correspondence to the specific pixel in the first partial printing to be executed first can be set equal to or smaller than the amount of ink to be discharged in correspondence to the specific pixel in the second partial printing to be executed later. As a result, it is possible to reduce the deformation of the printing medium due to the ink discharged in the first partial printing. Therefore, it is possible to reduce the failure, which is caused due to the deformation of the printing medium during the second partial printing.

Also, according to the first exemplary embodiment, in the special partial printing, a total amount of ink to be discharged in the first partial printing to be executed first is set equal to or smaller than a total amount of ink to be discharged in the second partial printing to be executed later. As a result, it is possible to reduce the deformation of the sheet M, which is caused due to the ink discharged in the first partial printing. As a result, it is possible to reduce the failure due to the deformation of the sheet M during the second partial printing.

Also, according to the first exemplary embodiment, in the special partial printing, as the dot corresponding to the specific pixel (for example, the pixel PX3) for which the formation of the medium dot is defined in the partial dot data, no dot is formed by the first partial printing and the medium dot is formed by the second partial printing. Likewise, in the special partial printing, as the dot corresponding to the specific pixel (for example, the pixel PX4) for which the formation of the small dot is defined in the partial dot data, no dot is formed by the first partial printing and the small dot is formed by the second partial printing. As a result, as described above, it is possible to reduce the total amount of ink to be discharged in the first partial printing and to increase the total amount of ink to be discharged in the second partial printing. Therefore, it is possible to further reduce the deformation of the sheet M due to the ink discharged in the first partial printing.

Also, according to the first exemplary embodiment, as the index value that is used so as to determine the specific condition indicating that the delay in ink supply may occur, the dot formation ratio DR, which is a value relating to the pass-use amount PA of ink, and the cumulative-use amount TA of ink are used. As a result, it is possible to appropriately determine whether the ink supply may be delayed.

Specifically, as described above, the larger the cumulative-use amount TA of ink is, the more the delay in ink supply is likely to occur. Also, the larger the pass-use amount PA of ink is, the more the specific delay in ink supply is likely to occur. Considering the situations, it is set in the threshold value table TT that the larger the cumulative-use amount TA of ink is, the smaller the determination threshold value JT, which is set for the dot formation ratio DR, is (FIG. 7A). As a result, it is possible to appropriately determine whether the ink supply may be delayed.

Also, the lower the head temperature Th is, the more the delay in ink supply is likely to occur. In the first exemplary embodiment, as the index value that is used so as to determine the specific condition, the head temperature Th is further used (FIG. 7A). For example, it is set in the threshold value table TT that the lower the head temperature Th is, the smaller the determination threshold value JT is (FIG. 7A). As a result, it is possible to appropriately determine whether the ink supply may be delayed by using the head temperature Th.

B. Second Exemplary Embodiment

Figure 9:
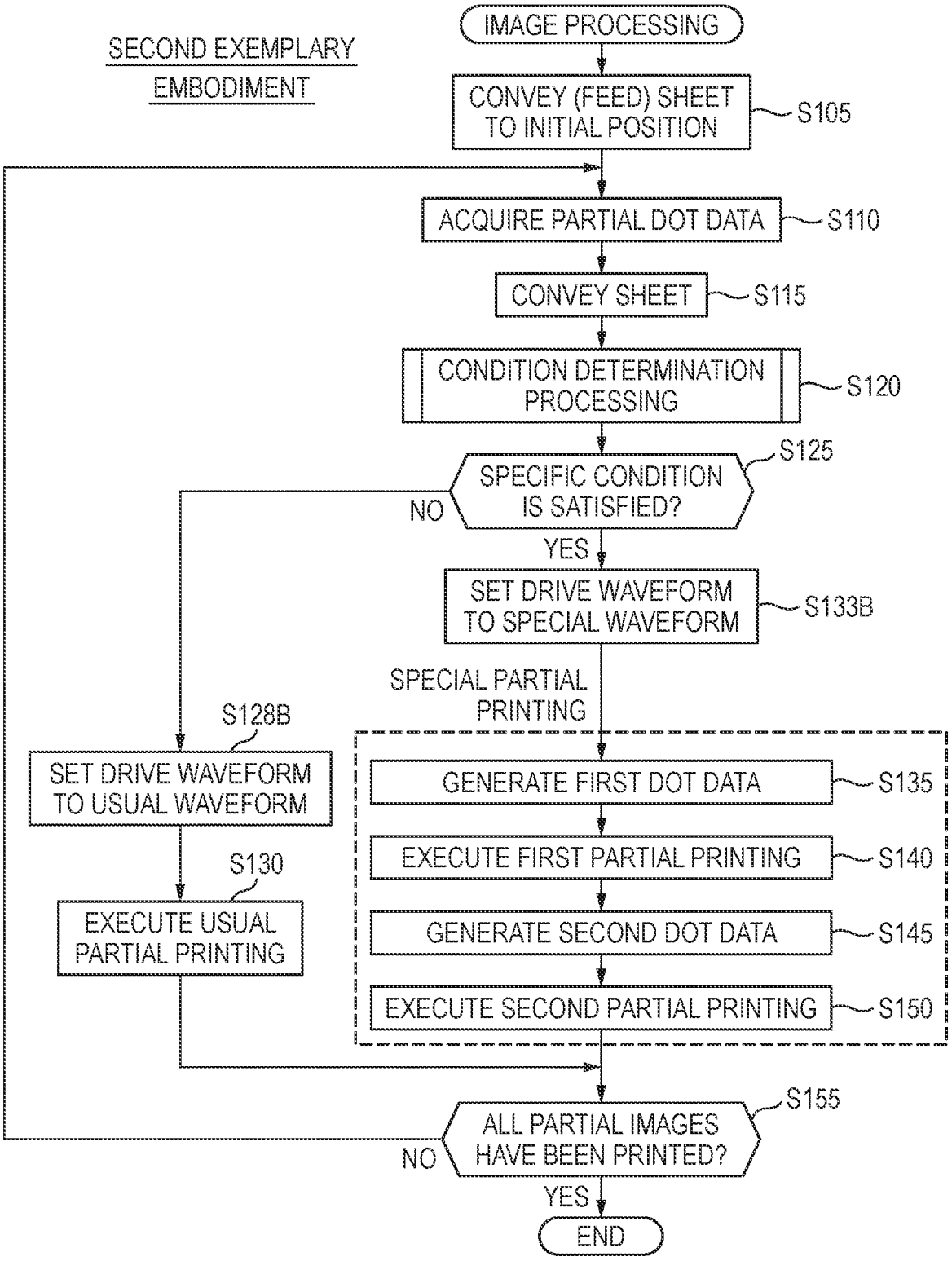
FIG. 9 is a flowchart of image processing of a second exemplary embodiment.

FIG. 9 is a flowchart of image processing of a second exemplary embodiment. FIGS. 10A and 10B depict an example of tables included in the control table group TG (FIG. 1) of the second exemplary embodiment. In the image processing of the second exemplary embodiment shown in FIG. 9, processing of S128B is executed before the usual partial printing of S130. Also, processing of S133B is executed before the special partial printing of S135 to S150. The other processing of the image processing of the second exemplary embodiment is the same as the image processing of FIG. 5. The control table group TG of the second exemplary embodiment includes the threshold value table TT of FIG. 7A, a replacement table RT2 (FIG. 10A) different from the replacement table RT (FIG. 7B) of the first exemplary embodiment, and a drive waveform table WT (FIG. 10B).

In the second exemplary embodiment, a dot size, which is actually formed in correspondence to a pixel value indicating the formation of the extra-large dot of the dot data (the partial dot data, the first dot data, the second dot data), is different between the usual partial printing and the special partial printing. Also, a dot size, which is actually formed in correspondence to a pixel value indicating the formation of the large dot of the dot data, is different between the usual partial printing and the special partial printing. Such change in dot size is implemented by changing a waveform (hereinafter, referred to as 'drive waveform') of a drive signal, which is supplied from the head drive unit 120 to the actuator of the printing head 110, between the usual partial printing and the special partial printing, in correspondence to the pixel value of the dot data.

Specifically, in S128B of FIG. 9, the CPU 210 sets the drive waveform as a waveform (also referred to as 'usual waveform') for usual partial printing. The setting of the usual waveform is made by setting a drive waveform, which corresponds to each of the pixel values indicative of the formations of the extra-large dot, the large dot, the medium dot and the small dot, to the head drive unit 120 in accordance with the drive waveform table WT (FIG. 10B).

In the second exemplary embodiment, five types of waveforms 1 to 5 different from each other are used. The drive waveform is a waveform corresponding to one dot. The more pluses included in one waveform are, the larger the amount of ink to be discharged is, so that a larger dot is formed. Also, the higher a maximum voltage of each pulse included in one waveform is, the larger the amount of ink to be discharged is, so that a larger dot is formed. The waveforms 1 to 5 are set so that as the waveform number increases, a larger dot is formed. The five types of dots corresponding to the waveforms 1 to 5 are Dots 1 to 5. As the dot number increases, a dot size increases. That is, the dot size is Dot 5>Dot 4>Dot 3>Dot 2>Dot 1. As shown in the drive waveform table WT, in the usual partial printing, the waveform 5, the waveform 4, the waveform 2 and the waveform 1 are respectively associated with the respective pixel values indicative of the formations of the extra-large dot, the large dot, the medium dot and the small dot, as the drive waveform. That is, in the usual partial printing, Dot 5, Dot 4, Dot 2 and Dot 1 are formed in correspondence to the respective pixel values indicative of the formations of the extra-large dot, the large dot, the medium dot and the small dot.

In S133B of FIG. 9, the CPU 210 sets the drive waveform as a waveform (also referred to as 'special waveform') for special partial printing. The setting of the special waveform is made by setting the drive waveforms, which correspond to the respective pixel values indicative of the formations of the extra-large dot, the large dot, the medium dot and the small dot, to the head drive unit 120 in accordance with the drive waveform table WT (FIG. 10B), like the usual waveform. As shown in the drive waveform table WT, in the special partial printing, the waveform 4, the waveform 3, the waveform 2 and the waveform 1 are respectively associated with the respective pixel values indicative of the formations of the extra-large dot, the large dot, the medium dot and the small dot, as the drive waveform. That is, in the special partial printing, Dot 4, Dot 3, Dot 2 and Dot 1 are formed in correspondence to the respective pixel values indicative of the formations of the extra-large dot, the large dot, the medium dot and the small dot.

As can be seen from the above descriptions, in the usual partial printing and in the special partial printing, the dot to be formed in correspondence to the pixel value indicative of the formation of the small dot is the dot (Dot 1) of the same size. In the usual partial printing and in the special partial printing, the dot to be formed in correspondence to the pixel value indicative of the formation of the medium dot is the dot (Dot 2) of the same size.

In contrast, the dot to be formed in correspondence to the pixel value indicative of the formation of the large dot is Dot 4 in the usual partial printing and is Dot 3 smaller than Dot 4 in the special partial printing. Also, the dot to be formed in correspondence to the pixel value indicative of the formation of the extra-large dot is Dot 5 in the usual partial printing and is Dot 4 smaller than Dot 5 in the special partial printing.

Here, in the second exemplary embodiment, the replacement table RT2 (FIG. 10B) is different from the first exemplary embodiment. For this reason, in the second exemplary embodiment, in S135, the first dot data is generated with reference to the replacement table RT2 different from the first exemplary embodiment. Also, in S145, the second dot data is generated with reference to the replacement table RT2 different from the first exemplary embodiment. For this reason, in the second exemplary embodiment, the first and second dot data to be generated are different from the first exemplary embodiment.

FIGS. 11A to 11C and 12A to 12C illustrate the partial printing of the second exemplary embodiment. FIG. 11A depicts the original dot image DI0 based on the partial dot data, like FIG. 8A of the first exemplary embodiment. FIG. 11B depicts a first dot image DI1*b* based on the first dot data of the second exemplary embodiment. As can be seen from FIG. 11B and the replacement table RT2, the first dot image DI1*b* is an image by deleting the medium dot and the small dot in the pixels of the original dot image DI0, in which the medium dot and the small dot are arranged, and replacing the extra-large dot in the pixels of the original dot image DI0, in which the extra-large dot and the large dot are arranged, with the large dot. The CPU 210 replaces the pixel value, which indicates the formation of the medium dot of the notice partial dot data, and the pixel value, which indicates the formation of the small dot, with the pixel value indicating that no dot is formed. Also, the CPU 210 replaces the pixel value, which indicates the formation of the extra-large dot of the notice partial dot data, with the pixel value, which indicates the formation of the large dot. Thereby, the first dot data is generated.

FIG. 11C depicts a second dot image DI2*b* based on the second dot data of the second exemplary embodiment. As can be seen from FIG. 11C and the replacement table RT2, the second dot image DI2*b* is totally the same as the original dot image DI0. In the second exemplary embodiment, the CPU 210 uses the notice partial dot data, as second partial data, as it is.

Here, in the second exemplary embodiment, as described above, the drive waveform is changed between the usual partial printing and the special partial printing. For this reason, even in the case that the partial dot data to be used in the usual partial printing and the second dot data to be used in the second partial printing of the special partial printing are the same, a dot image (also referred to as 'actual dot image') to be actually printed on the sheet M is different between the usual partial printing and the second partial printing.

FIG. 12A conceptually depicts a usual actual dot image RI0, which is printed on the sheet M by the usual partial printing that is executed using the partial dot data corresponding to the original dot image DI0 of FIG. 11A. FIG. 12B conceptually depicts a first actual dot image RI1, which is printed on the sheet M by the first partial printing that is executed using the first dot data corresponding to the first dot image DI1*b* of FIG. 11B. FIG. 12C conceptually depicts a second actual dot image RI2, which is printed on the sheet M by the second partial printing that is executed using the second dot data corresponding to the second dot image DI2*b* of FIG. 11C. In the usual actual dot image RI0, a plurality of rectangles aligned in a matrix shape indicates corresponding pixels PX of the original dot image DI0. Each of the numbers 1 to 5 in the respective pixels PX indicates a type of a dot (any one of Dots 1 to 5) to be formed at a position on the sheet M, which corresponds to the pixel PX. The empty pixel PX indicates that no dot is formed at a position on the sheet M corresponding to the pixel PX. This applies to the actual dot images RI1, RI2 of FIGS. 12B and 12C, too.

As shown in FIGS. 12A to 12C, in the special partial printing of the second exemplary embodiment, Dot 3 smaller than Dot 5 is formed by the first partial printing and Dot 4 smaller than Dot 5 is formed by the second partial printing at the position on the sheet M at which Dot 5 is to be formed in a case where the notice partial printing is performed by the usual partial printing. Likewise, in the special partial printing, Dot 3 is formed by the first partial printing and Dot 3 is formed by the second partial printing at the position on the sheet M at which Dot 4 is to be formed in a case where the notice partial printing is performed by the usual partial printing. In the special partial printing of the second exemplary embodiment, no dot is formed by the first partial printing and Dot 1 or Dot 2 is formed by the second partial printing at the position on the sheet M at which Dot 1 or Dot 2 is to be formed in a case where the notice partial printing is performed by the usual partial printing.

According to the second exemplary embodiment, in the usual partial printing, Dot 5 is formed as the dot corresponding to the specific pixel PX1 in the notice partial image (FIG. 12A). In the special partial printing, as the dot corresponding to the specific pixel PX1, Dot 3 smaller than Dot 5 is formed by the first partial printing and Dot 4 smaller than Dot 5 is formed by the second partial printing (FIGS. 12B and 12C)). Also, in the usual partial printing, Dot 4 is formed as the dot corresponding to the specific pixel PX2 (FIG. 8A). In the special partial printing, as the dot corresponding to the specific pixel PX2, Dot 3 smaller than Dot 4 is formed by the first partial printing and Dot 3 smaller than Dot 4 is formed by the second partial printing (FIGS. 12B and 12C). Therefore, like the first exemplary embodiment, while reducing the delay in ink supply, it is possible to reduce the deterioration of the image quality as a result of reducing the delay in ink supply.

Meanwhile, in the second exemplary embodiment, when two Dots 3 are formed at the specific position on the sheet M, the two superimposed Dots 3 become a dot having an area equivalent to one Dot 4. Also, when one Dot 3 and one Dot 4 are formed at the specific position on the sheet M, the two superimposed dots become a dot having an area equivalent to one Dot 5.

Also, according to the second exemplary embodiment, in the usual partial printing, the dot size, which is formed based on the pixel value indicative of the formation of the extra-large dot, is set to a predetermined size (a size of Dot 5) (S123B in FIG. 9, FIG. 10B, and FIG. 12A), and in the special partial printing, the dot size, which is formed based on the pixel value indicative of the formation of the extra-large dot, is set to a size (a size of Dot 4) smaller than the predetermined size (S133B in FIG. 9, FIG. 10B, and FIG. 12C). Also, in the usual partial printing, the dot size, which is formed based on the pixel value indicative of the formation of the large dot, is set to a predetermined size (a size of Dot 4) (S123B in FIG. 9, FIG. 10B, and FIG. 12A), and in the special partial printing, the dot size, which is formed based on the pixel value indicative of the formation of the large dot, is set to a size (a size of Dot 3) smaller than the predetermined size (S133B in FIG. 9, FIG. 10B, and FIG. 12B). As a result, it is possible to more flexibly control the dot size between the usual partial printing and the special partial printing. For example, in the first exemplary embodiment, when two medium dots are formed at the specific position on the sheet M, the two superimposed medium dots become a dot having an area equivalent to one large dot. However, depending on the specification of the printer 200, the two superimposed medium dots may not be a dot having an area equivalent to one large dot. Even in the case, according to the second exemplary embodiment, the drive waveform is changed, so that it is possible to use Dot 3, which is not used in the usual partial printing, in the special partial printing, in addition to Dots 1, 2, 4 and 5 that are used in the usual partial printing, for example. As a result, it is possible to appropriately implement the expression of the image having substantially the same densities between the partial image, which is printed using the specific partial dot data by the usual partial printing, and the partial image, which is printed using the specific partial dot data by the special partial printing. In addition, even when the types of dots to be used for printing increase, it is not necessary to increase the number of bits of dot data, so that it is possible to suppress the size of the dot data from excessively increasing.

C. Modified Embodiments (1) In the first exemplary embodiment, the four types of dots "small", "medium", "large" and "extra-large" are used for printing. However, the present disclosure is not limited thereto. For example, the three types of dots "small", "medium" and "large" may be used. In this case, for example, when the large dot is formed in the usual partial printing, as the dot corresponding to the specific pixel in the partial image, the medium dot is formed by the first partial printing and the medium dot is formed by the second partial printing in the special partial printing, as the dot corresponding to the specific pixel. Also, the two types of dots "small" and "large" may be used. In this case, for example, when the large dot is formed in the usual partial printing, as the dot corresponding to the specific pixel in the partial image, the small dot is formed by the first partial printing and the small dot is formed by the second partial printing in the special partial printing, as the dot corresponding to the specific pixel.

(2) In the above exemplary embodiments, in the special partial printing, the first dot data and the second dot data are generated using the partial dot data (for example, S135 and S145 in FIG. 5). Instead of this configuration, the CPU 210 may acquire CMYK image data corresponding to the notice partial image, and generate first CMYK image data for first partial printing and second CMYK image data for second partial printing by using the CMYK image data, for example. For example, the CMYK image data, which is obtained by halving the component value (for example, the component value of 256 gradations of C, M, Y and K) of each pixel of the original CMYK image data, is set as first and second CMYK image data. The CPU 210 may execute halftone processing for the first and second CMYK image data, thereby generating first and second dot data. Also in this case, for at least one specific pixel, the extra-large dot may be formed in the usual partial printing and the dot smaller than the extra-large dot may be formed by both the first and second partial printing in the special partial printing.

(3) In the first exemplary embodiment, in the special partial printing, as the dot corresponding to the pixel for which the formation of the extra-large dot by the partial dot data is defined, the medium dot is formed by the first partial printing, and the large dot is formed by the second partial printing. Instead of this configuration, as the dot corresponding to the pixel for which the formation of the extra-large dot by the partial dot data is defined, the large dot may be formed by the first partial printing, and the medium dot may be formed by the second partial printing.

(4) In the first exemplary embodiment, in the special partial printing, as the dot corresponding to the pixel for which the formation of the medium dot and the small dot by the partial dot data is defined, no dot is formed by the first partial printing and the medium dot and the small dot are formed by the second partial printing (FIGS. 8A to 8C). Instead of this configuration, as the dot corresponding to the pixel for which the formation of the medium dot and the small dot by the partial dot data is defined, the small dot may be formed and no medium dot may be formed by the first partial printing, and the medium dot may be formed and no small dot may be formed by the second partial printing. Alternatively, the medium dot and the small dot may be formed by the first partial printing, and no small dot and medium dot may be formed by the second partial printing.

(5) In the respective exemplary embodiments, it is determined whether the specific condition, which indicates that the ink supply may be delayed, is satisfied in each partial printing (S125 in FIGS. 5 and 9). Instead of this configuration, it may be determined whether the specific condition is satisfied whenever the print image OI is printed. In this case, for example, an index value relating to an ink amount to be used when printing the entire print image OI is calculated, and when the index value is equal to or greater than a predetermined threshold value, it is determined that the specific condition is satisfied.

(6) In the respective exemplary embodiments, the condition indicating whether the delay in ink supply may occur is determined using the head temperature Th, the cumulative-use amount TA of ink and the dot formation ratio DR. However, the present disclosure is not limited thereto. For example, only the head temperature Th and the dot formation ratio DR may be used. In this case, for example, in the threshold value table TT of FIG. 7A, only three determination threshold values JT corresponding to three types of head temperatures Th (low, medium and high) may be defined. Also, only the cumulative-use amount TA of ink and the dot formation ratio DR may be used. In this case, in the threshold value table TT, only three determination threshold values JT corresponding to three types of cumulative-use amounts TA of ink (small, medium and large) may be defined.

(7) Instead of the dot formation ratio DR, a separate index value relating to the pass-use amount PA of ink may be adopted. For example, the separate index value may be a total number of dots of each ink to be formed when printing the notice partial image. Also, for example, the separate index value may be a cumulative value of the component value of each ink of the CMYK image data corresponding to the notice partial image. Also, instead of the cumulative-use amount TA of ink, a separate index value relating to the cumulative-use amount of ink may be adopted. For example, the separate index value may be a cumulative number of printed sheets or may be a cumulative number of replacement times of the ink cartridge. It can be said that the greater the cumulative number of printed sheets or the cumulative number of replacement times is, the larger the cumulative-use amount TA of ink is. Therefore, it can be said that the cumulative number of printed sheets is an index value relating to the cumulative-use amount TA of ink.

(8) In the printing mechanism 100 of the respective exemplary embodiments, the sub-scanning in which the conveyor unit 140 conveys the sheet M to move the sheet M relative to the printing head 110 in the conveying direction is performed. Instead of this configuration, the sub-scanning may be performed by moving the printing head 110 relative to the fixed sheet M in an opposite direction to the conveying direction.

(9) In the special partial printing of the respective exemplary embodiments, the notice partial image is printed by the two partial printings that are executed without conveying the sheet M. Instead of this configuration, in the special partial printing, the notice partial image may be printed by three or more partial printings that are executed without conveying the sheet M. For example, when the notice partial image is printed by the three partial printings, the small dot is respectively formed by the three partial printings, at a position corresponding to the pixel value, which indicates the formation of the extra-large dot in the notice partial dot data. At a position corresponding to the pixel value indicative of the formation of the large dot, the small dot is respectively formed by the last two partial printings of the three partial printings. At positions corresponding to the pixel values indicative of the formation of the medium dot and the small dot, the medium dot and the small dot are formed by the last partial printing of the three partial printings.

(10) As the printing medium, instead of the sheet M, other media such as an OHP film, a CD-ROM, and a DVD-ROM may be adopted.

(11) In the respective exemplary embodiments, the device configured to execute the image processing of FIGS. 5 and 9 is the CPU 210 of the printer 200. Instead of this configuration, the device configured to execute the image processing of FIGS. 5 and 9 may be other device, for example, the terminal apparatus 300. In this case, for example, the terminal apparatus 300 operates as a printer driver by executing a driver program, and controls the printer 200, which is the printing execution unit, as a part of functions of the printer driver, thereby executing the image processing of FIGS. 5 and 9. In this case, the terminal apparatus 300 implements the conveyance of the sheet M in S105 of FIG. 5 by transmitting a conveyance command including information about a conveying amount of the sheet M to the printer 200, for example. Also, in this case, the terminal apparatus 300 acquires the head temperature Th and the cumulative-use amount TA of ink from the printer 200, in S210 and S220 of FIG. 6. Also, the terminal apparatus 300 implements the partial printing of S130, S140 and S150 in FIG. 5 by transmitting a partial printing command including the dot data to the printer 200, for example.

As can be seen from the above descriptions, in the respective exemplary embodiments, the printing mechanism 100 is an example of the printing execution unit. Meanwhile, like this modified embodiment, in a case where the terminal apparatus 300 executes the image processing, the entire printer 200 configured to execute the printing is an example of the printing execution unit.

(12) The device configured to execute the image processing of FIGS. 5 and 9 may be a server configured to acquire image data from the printer 200 or the terminal apparatus 300, to generate the conveying command or the partial printing command by using the image data, and to transmit the command to the printer 200. The server may be a plurality of calculators capable of performing communication each other via the network.

(13) In the respective exemplary embodiments, some of the configuration implemented by hardware may be replaced with software, and some or all of the configuration implemented by software may be replaced with hardware. For example, some of the image processing shown in FIGS. 5 and 9 may be implemented by a dedicated hardware circuit (for example, ASIC) configured to operate in response to an instruction from the CPU 210.

Although the present disclosure has been described with reference to the exemplary embodiments and the modified embodiments, the embodiments of the present disclosure are provided so as to easily understand the present disclosure, not to limit the present disclosure. The present disclosure can be changed and improved without departing from the spirit thereof, and the present disclosure includes equivalents thereof.

What is claimed is:

1. An image processing device for a printing execution unit including: a printing head having a plurality of nozzles configured to discharge ink; an ink supply unit configured to supply the ink to the printing head; a main scanning unit configured to execute a main scanning in which the printing head is moved relative to a printing medium in a main scanning direction; and a sub-scanning unit configured to execute a sub-scanning in which the printing medium is moved relative to the printing head in a sub-scanning direction intersecting with the main scanning direction, the image processing device comprising:

a controller configured to perform:

acquiring image data; and causing the printing execution unit to perform printing by using the acquired image data, the printing being performed by executing, for a plurality of times, (i) partial printing in which the printing head is caused to discharge the ink while causing the main scanning unit to execute the main scanning and (ii) sub-scanning in which the sub-scanning unit is caused to execute the sub-scanning, wherein the printing execution unit is caused to perform the printing by:

in a first case where a specific condition is not satisfied, printing a partial image by single partial printing, the partial image being a part of an image to be printed and corresponding to the partial printing, the specific condition being determined for each partial image, and the specific condition indicating that ink supply from the ink supply unit to the printing head may be delayed in the partial printing;

in a second case where the specific condition is satisfied, printing the partial image by a plurality of partial printings including a first partial printing and a second partial printing;

in the first case, forming a dot having a specific size by the single partial printing, as a dot corresponding to a specific pixel in the partial image; and in the second case, forming a dot having a size smaller than the specific size by the first partial printing and forming a dot having a size smaller than the specific size by the second partial printing, as the dot corresponding to the specific pixel.

2. The image processing device according to claim 1, wherein the image data includes partial dot data which indicates a formation state of a dot for each pixel of a plurality of pixels in the partial image, and wherein the printing execution unit is caused to perform the printing by:

in the first case, forming the dot having the specific size by the single partial printing, as a dot corresponding to a pixel for which formation of a dot having the specific size is defined by the partial dot data; and in the second case, forming the dot having the size smaller than the specific size by the first partial printing and forming the dot having the size smaller than the specific size by the second partial printing, as the dot corresponding to the pixel for which formation of the dot having the specific size is defined by the partial dot data.

3. The image processing device according to claim 2, wherein the partial dot data includes a specific pixel value indicative of the formation of the dot having the specific size, and wherein the printing execution unit is caused to perform the printing by:

in the first case, executing the single partial printing by using the partial dot data, in the second case, generating first dot data and second dot data by changing the specific pixel value in the partial dot data to a value indicative of formation of a dot having a size smaller than the specific size; and in the second case, executing the first partial printing by using the first dot data and executing the second partial printing by using the second dot data.

4. The image processing device according to claim 2, wherein the partial dot data includes a specific pixel value indicative of the formation of the dot having the specific size; and wherein the printing execution unit is caused to perform the printing by:

in the first case, setting a size of a dot to be formed based on the specific pixel value to the specific size; and in the second case, setting the size of the dot to be formed based on the specific pixel value to a size smaller than the specific size.

5. The image processing device according to claim 1, wherein the printing execution unit is caused to perform the printing by:

in the second case, executing the second partial printing after the first partial printing; and in the second case, forming a dot having a first size smaller than the specific size by the first partial printing and forming a dot having a second size smaller than the specific size and equal to or larger than the first size by the second partial printing, as the dot corresponding to the specific pixel.

6. The image processing device according to claim 1, wherein the printing execution unit is caused to perform the printing by:

in the second case, executing the second partial printing after the first partial printing; and in the second case, setting a total amount of ink to be discharged in the first partial printing to be equal to or smaller than a total amount of ink to be discharged in the second partial printing.

7. The image processing device according to claim 6, wherein the printing execution unit is caused to perform the printing by:

in the first case, forming a dot having a size smaller than the specific size by the single partial printing, as a dot corresponding to a pixel different from the specific pixel in the partial image; and in the second case, forming a dot having a size smaller than the specific size by the second partial printing, as the dot corresponding to the pixel different from the specific pixel, without forming a dot corresponding to the pixel different from the specific pixel by the first partial printing.

8. The image processing device according to claim 1, wherein the specific condition is determined by using an index value, and wherein the index value includes at least one of a value relating to a use amount of the ink which is calculated by using partial image data corresponding to the partial image and is to be used for printing the partial image, a value relating to a cumulative-use amount of the ink used for printing by the printing execution unit, and a value relating to a temperature of the printing execution unit.

9. A printing apparatus comprising:

the image processing device according to claim 1; and the printing execution unit.

10. A non-transitory computer readable storage medium storing a program for controlling a printing execution unit including: a printing head having a plurality of nozzles configured to discharge ink; an ink supply unit configured to supply the ink to the printing head; a main scanning unit configured to execute a main scanning in which the printing head is moved relative to a printing medium in a main scanning direction; and a sub-scanning unit configured to execute a sub-scanning in which the printing medium is moved relative to the printing head in a sub-scanning direction intersecting with the main scanning direction, the program, when executed by a computer of a controller, causing the controller to perform:

acquiring image data; and causing the printing execution unit to perform printing by using the acquired image data, the printing being performed by executing, for a plurality of times, (i) partial printing in which the printing head is caused to discharge the ink while causing the main scanning unit to execute the main scanning and (ii) sub-scanning in which the sub-scanning unit is caused to execute the sub-scanning, wherein the printing execution unit is caused to perform the printing by:

in a first case where a specific condition is not satisfied, printing a partial image by single partial printing, the partial image being a part of an image to be printed and corresponding to the partial printing, the specific condition being determined for each partial image, and the specific condition indicating that ink supply from the ink supply unit to the printing head may be delayed in the partial printing;

in a second case where the specific condition is satisfied, printing the partial image by a plurality of partial printings including a first partial printing and a second partial printing;

in the first case, forming a dot having a specific size by the single partial printing, as a dot corresponding to a specific pixel in the partial image; and in the second case, forming a dot having a size smaller than the specific size by the first partial printing and forming a dot having a size smaller than the specific size by the second partial printing, as the dot corresponding to the specific pixel.

11. The storage medium according to claim 10, wherein the image data includes partial dot data which indicates a formation state of a dot for each pixel of a plurality of pixels in the partial image, and wherein the printing execution unit is caused to perform the printing by:

in the first case, forming the dot having the specific size by the single partial printing, as a dot corresponding to a pixel for which formation of a dot having the specific size is defined by the partial dot data; and in the second case, forming the dot having the size smaller than the specific size by the first partial printing and forming the dot having the size smaller than the specific size by the second partial printing, as the dot corresponding to the pixel for which formation of the dot having the specific size is defined by the partial dot data.

12. The storage medium according to claim 11, wherein the partial dot data includes a specific pixel value indicative of the formation of the dot having the specific size, and wherein the printing execution unit is caused to perform the printing by:

in the first case, executing the single partial printing by using the partial dot data, in the second case, generating first dot data and second dot data by changing the specific pixel value in the partial dot data to a value indicative of formation of a dot having a size smaller than the specific size; and in the second case, executing the first partial printing by using the first dot data and executing the second partial printing by using the second dot data.

13. The storage medium according to claim 11, wherein the partial dot data includes a specific pixel value indicative of the formation of the dot having the specific size; and wherein the printing execution unit is caused to perform the printing by:

in the first case, setting a size of a dot to be formed based on the specific pixel value to the specific size; and in the second case, setting the size of the dot to be formed based on the specific pixel value to a size smaller than the specific size.

14. The storage medium according to claim 10, wherein the printing execution unit is caused to perform the printing by:

in the second case, executing the second partial printing after the first partial printing; and in the second case, forming a dot having a first size smaller than the specific size by the first partial printing and forming a dot having a second size smaller than the specific size and equal to or larger than the first size by the second partial printing, as the dot corresponding to the specific pixel.

15. The storage medium according to claim 10, wherein the printing execution unit is caused to perform the printing by:

in the second case, executing the second partial printing after the first partial printing; and in the second case, setting a total amount of ink to be discharged in the first partial printing to be equal to or smaller than a total amount of ink to be discharged in the second partial printing.

16. The storage medium according to claim 15, wherein the printing execution unit is caused to perform the printing by:

in the first case, forming a dot having a size smaller than the specific size by the single partial printing, as a dot corresponding to a pixel different from the specific pixel in the partial image; and in the second case, forming a dot having a size smaller than the specific size by the second partial printing, as the dot corresponding to the pixel different from the specific pixel, without forming a dot corresponding to the pixel different from the specific pixel by the first partial printing.

17. The storage medium according to claim 10, wherein the specific condition is determined by using an index value, and wherein the index value includes at least one of a value relating to a use amount of the ink which is calculated by using partial image data corresponding to the partial image and is to be used for printing the partial image, a value relating to a cumulative-use amount of the ink used for printing by the printing execution unit, and a value relating to a temperature of the printing execution unit.

* * * * *